US006176489B1

(12) United States Patent
Astaneha

(10) Patent No.: US 6,176,489 B1
(45) Date of Patent: Jan. 23, 2001

(54) COMBINATION DICE AND ROULETTE-TYPE GAMBLING GAME AND METHOD FOR PLAYING THE SAME

(76) Inventor: Morteza Astaneha, 77 Prospect Ave., Apartment 4-1, Hackensack, NJ (US) 07601

( * ) Notice: Under 35 U.S.C. 154(b), the term of this patent shall be extended for 0 days.

(21) Appl. No.: 09/314,354

(22) Filed: May 19, 1999

(51) Int. Cl.[7] ..... A63F 1/00
(52) U.S. Cl. ..... 273/274; 273/138.1; 273/146
(58) Field of Search ..... 273/274, 292, 273/138.1, 146, 141 R, 141 A, 142 A, 142 B–142 G, 142 J, 142 JA, 142 JB, 142 JC, 142 JD, 144 B

(56) References Cited

U.S. PATENT DOCUMENTS

| | | | |
|---|---|---|---|
| D. 106,967 | | 11/1937 | Danon . |
| 2,253,787 | | 8/1941 | Kelly . |
| 3,889,954 | * | 6/1975 | Malisow . |
| 3,913,919 | | 10/1975 | Carpenter . |
| 4,149,728 | | 4/1979 | Thompson . |
| 4,247,114 | | 1/1981 | Carroll . |
| 4,346,900 | | 8/1982 | Lamlee . |
| 4,515,372 | * | 5/1985 | Gonzales . |
| 4,941,665 | | 7/1990 | Klamer . |
| 5,133,559 | | 7/1992 | Page . |
| 5,746,432 | * | 5/1998 | Feola . |
| 5,785,596 | | 7/1998 | Hobert . |

* cited by examiner

*Primary Examiner*—William M. Pierce
(74) *Attorney, Agent, or Firm*—Richard M. Goldberg

(57) ABSTRACT

A gambling game includes a dice table having an upper throwing surface on which dice can be thrown; two dice to be thrown on the upper throwing surface by a player, each die including six faces, with numbers "1" through "6" and three colors, with only two faces having a common color; a rotatable wheel to be rotated by a dealer and positioned adjacent the dice table, the rotatable wheel having eight segmented areas, six including respective numbers "1" through "6" and three colors, with only two segmented areas having a common color, and two segmented areas being all lose segmented areas in which a player loses all wagers, regardless of color combinations and number combinations that result; a pointer fixed at a periphery of the rotatable wheel and positioned to point to each area as the areas pass by the pointer; and a wagering area for wagering on color combinations and number combinations from a combination of colors and numbers both on the upper faces of the dice and a segmented area of the rotatable wheel pointed to by the pointer, the wagering area including boxed areas for wagering on individual numbers, groups of numbers and colors.

24 Claims, 2 Drawing Sheets

DEALER
RED 1
GREEN 2
BLUE 3
ALL LOSE
RED 4
GREEN 5
BLUE 6
ALL LOSE
TRIPLE
RED AND BLUE
ALL GREEN
RED - GREEN - BLUE
GREEN AND RED
ALL RED
BLUE AND GREEN
ALL BLUE
3 THROUGH 10
11 THROUGH 18
ODD
EVEN
3 4 5 6 7 8 9 10 11 12 13 14 15 16 17 18
10 11 12 14 16 18 20 22 24 25 26 27 28 30 32 32a 32b 32c 32d 32e 32f 32g 32h 34 36 36a 36b 40 41 42 44 46 48 50 52 54 56 58 60 62 64 66

COMBINATION DICE AND ROULETTE-TYPE GAMBLING GAME AND METHOD FOR PLAYING THE SAME

BACKGROUND OF THE INVENTION

The present invention relates generally to a combination dice and roulette-type gambling game, and more particularly, is directed to a combination dice and roulette-type gambling game that provides more variations in play and in wagering.

In a conventional roulette game, there is a rotatable roulette wheel that has numbered pockets with numbers "1" through "36", "0" and "00" therein. The pockets with numbers "0" and "00" give the house or dealer an advantage of 5.26%. Each pocket is separated from its neighbors by metal dividers. Half of the 36 numbers are black while the other half are red. The pockets containing the numbers "0" and "00" are green. The numbers are not in consecutive order, but rather, are in random order, with red and black numbers alternating, except when broken up by "0" and "00".

There are numerous possible wagers that can be made, which are paid off at different odds. For example, for even money, that is 1:1 pay off, there are wagers on odd numbers, even numbers, red numbers, black numbers, a range of low numbers "1" through "18" and a range of high numbers "19" through "36". For higher odds, such as 35:1, a player can wager on a single number, while wagers on two numbers pay off at 17:1; wagers on three numbers pay off at 11:1; wagers on four numbers pay off at 8:1; wagers on five numbers pay off at 6:1; wagers on six numbers pay off at 5:1; wagers on dozens, such as "1" through "12", "13" through "24" or "25" through "36" pay off at 2:1, as would wagers on one of the three columns of numbers.

However, gambling with a roulette wheel by itself can become boring or tiresome over time. In the first place, there is only one item moving at a time, namely, the ball about the wheel. Second, the players have no input into the chance outcome, since the dealer spins the wheel. Thus, the players can only wager on the above discussed combinations. Third, although there is some variation in the types of wagers that can be made, the types of wagers are still somewhat limited. As a result, the players can become easily bored after a short time, and retire from the game, which is undesirable to the casino.

The same comments apply to other roulette-type games, such as wheel of fortune games in casinos, in which the dealer spins a wheel having arcuate segments thereon, and a flexible pointer is provided to eventually stop the wheel and point to a particular segment having a monetary amount listed thereon. Such games are even less interesting, since there is no color aspect thereto.

The use of dice in a gambling game is known from the game of craps. In craps, there is a table with betting areas thereon, and two dice, each having numbers "1" through "6" thereon. With craps, the probability of rolling different number combinations varies. For example, the probability of rolling a number combination "7" is greater than rolling a number combination "4".

In craps, each of the number combinations "2", "3" and "12" is termed "craps", and is a loser. Each of the number combinations "7" and "11" is termed a "natural" and is a winner. The remaining number combinations are termed "point-numbers" and must be repeated before a number combination "7" is rolled, in order to win. Thus, the number combination "7" can be a winning combination if thrown on a first roll, and a losing combination if not thrown on a first roll. The player or shooter loses the dice to another player or shooter only when the first player throws a "seven-out", that is, the player throws a number combination "7" before repeating a first thrown number combination "4" through "6" or "8" through "10".

Various wagers can be made in craps. For example, there is an area called a "pass line". When bets are placed in this area, the players are wagering that the shooter will throw a repeat number combination before the number combination "7". Since the probability of throwing a number combination "7" is greater than other number combinations, it is best to wager on the "come-out" roll since the number combination "7" is then a winning combination. The house or dealer has a 1.41 percent advantage overall considering the come-out and point-numbers.

There are also odds bets. This depends on the different probabilities of throwing numbers. For example, the probability of throwing a number combination "7" is 5:1; of repeating a number combination "6" or "8" before throwing a number combination "7" is 6:5; of repeating a number combination "5" or "9" before throwing a number combination "7" is 3:2; of repeating a number combination "4" or "10" before throwing a number combination "7" is 2:1. Odds bets are paid off on the actual probabilities.

Other wagers are also possible. However, because of the different wagers and probabilities, the game of craps becomes relatively complicated to play. A casual observer in a casino, who knows little about casino games, would determine that craps is the most complicated and difficult to learn, game. This is because, unlike roulette, the table layout looks complicated, and there are so many different types of complicated bets, resulting in much confusion. For example, sometimes the number "7" wins and sometimes it does not.

However, unlike roulette, craps or dice tables bring out the emotions of the players more than other gambling games. This is because there is a certain camaraderie among the players, which does not occur with roulette.

Various games have been proposed which use some of the aspects of a craps game and some of the aspects of a roulette or roulette-type game, but no combination thereof.

For Example, U.S. Pat. No. 4,247,114 to Carroll disclose a board game similar to craps and which uses three dice, one a red color, one a green color and the last a white color. The players can wager on a particular number of a particular die, odd or even numbers, etc. However, there is no input by the dealer as in roulette or wheel of fortune games, and the wagering of this game can be complicated in the manner of a craps game.

U.S. Pat. No. 5,133,559 to Page discloses a casino dice game which uses six dice, including three larger size dice and three smaller size dice, each with numbers "1" through "6" thereon, and each having a single color, for example, there may be two red, two blue and two white dice. Betting can be based on different combinations of colors as shown in Table 3 in column 7 of the patent. However, this game is also relatively complicated from a wagering standpoint, and there is again no input by the dealer as in roulette or wheel of fortune games.

U.S. Pat. No. 4,346,900 to Lamlee discloses a game board with dice having opposite faces colored the same and the different faces are numbered as well from "1" through "6". This game includes three concentric rings on the game board for placing different wagers from rolls of the dice. Thus, for example, the outer ring includes areas in which the colors can be bet, while the inner rings include areas in which the numbers can be bet. However, there is again no input by the dealer as in roulette or wheel of fortune games, and the board and wagering arrangement is relatively complicated.

U.S. Design Pat. No. Des. 106,967 shows a combination game board and apparatus in which a roulette wheel is provided with different numbers and colors that can be bet, including even numbers, odd numbers, ranges of numbers, particular numbers and different color combinations. However, this only corresponds to a conventional roulette wheel in which there is no input by the players, except for the wagering.

U.S. Pat. No. 2,253,787 to Kelly discloses a game which uses an inner ring and an outer ring, both concentrically surrounding a stationary central area on the game board. There are numbers "1" through "6" in the stationary central area, each number corresponding to six segments on each inner and outer ring. There are also individual game boards and dice having numbers thereon. The first die has one color, for example, red, and the second die has another color. In use, the user throws the dice. The user then locates the segmented area on the inner ring corresponding to the stationary number in the central area, in response to the number on the first die. The user then locates the particular number from the six segment area of the inner ring based on the number on the second die, and reads the directions on the outer ring as to what action to take, for example, "Draw 20,000." However, this is a board game only, and the determination of an outcome is only made by the player from the roll of the dice. The inner and outer rings are set in advance, and are not rotated during the throw of the dice. Further, the colors on the dice are not used for any purpose, except to associate with the inner and outer rings.

U.S. Pat. No. 3,913,919 to Carpenter discloses a game including three dice, each having a different color, and each having six sides. The player makes a wager, and then throws the three dice. If any of the combinations in column 2 of the patent occur, the player wins. The player also previously placed three cards having symbols thereon face down, so that only the player knows what it is on the cards. After the player rolls the dice, he can bet additional money to try to bluff the other players to believe that the roll of the dice matches the three cards. However, there is no roulette wheel or wheel of fortune, and there is no input by the dealer. Also, the wagering can be relatively complicated.

U.S. Pat. No. 4,149,728 to Thompson discloses a poker game using a roulette wheel. The roulette wheel is spun, and a card corresponding to the item on the roulette wheel is selected and placed on the playing table. Thus, the roulette wheel is merely a way of selecting cards for display. Wagers can be placed on groups of cards or poker hands.

U.S. Pat. No. 4,941,665 to Klamer discloses a rotatable game including a center rotatable wheel with outer discs having different colors and a plurality of numbers thereon. However, there are no dice, and the game is relatively complicated to play.

U.S. Pat. No. 5,785,596 to Hobert discloses a craps or dice game and which further provides a super jackpot. A player must match the numbers of the super jackpot to win the super jackpot. The game, however, is a craps game only. The super jackpot can be selected by computer or mechanical arrangements, such as a roulette wheel.

OBJECTS AND SUMMARY OF THE INVENTION

Accordingly, it is an object of the present invention to provide a gambling game that overcomes the problems with the aforementioned prior art.

It is another object of the present invention to provide a gambling game that includes a combination of a rotatable wheel and dice.

It is still another object of the present invention to provide a gambling game in which action is required by both the player and the house.

It is yet another object of the present invention to provide a gambling game with an increased number and variation of ways to wager.

It is a further object of the present invention to provide a gambling game that maintains the interest and camaraderie of the players in the game.

It is a still further object of the present invention to provide a gambling game in which the players can easily understand the different wagers that can be made.

It is a yet further object of the present invention to provide a gambling game that is easy and economical to use and manufacture.

In accordance with an aspect of the present invention, a gambling game includes a dice table having an upper throwing surface on which dice can be thrown; at least one die to be thrown on the upper throwing surface by a player, each die having a plurality of faces, each face having a number and a color thereon, with the numbers and colors of at least some of the faces being different from the numbers and colors of other ones of the faces; a rotatable wheel to be rotated by a dealer and positioned adjacent the dice table, the rotatable wheel having a plurality of areas with different numbers and colors thereon; a pointer fixed at a periphery of the rotatable wheel and positioned to point to each area as the areas pass by the pointer; and a wagering area for wagering on color combinations and number combinations from a combination of colors and numbers both on the upper faces of the at least one die and an area of the rotatable wheel pointed to by the pointer.

Preferably, there are two dice, each including six faces, and each face with a respective number "1" through "6". Also, a first two of the faces include a first color, a second two of the faces include a second color, and a third two of the faces include a third color.

The wheel includes at least six areas thereon which are formed as segments of the wheel, each including a respective number "1" through "6" and a first two of the areas including a first one of the colors, a second two of the areas including a second one of the colors, and a third two of the areas including a third one of the colors. The wheel also includes at least one additional all lose area in which a player loses all wagers, regardless of color combinations and number combinations that result.

The wagering area includes boxed areas for wagering on a) individual numbers based on combinations of numbers both on the upper faces of the at least one die and an area of the rotatable wheel pointed to by the pointer; b) groups of numbers based on combinations of numbers both on the upper faces of the at least one die and an area of the rotatable wheel pointed to by the pointer; and c) colors based on combinations of colors both on the upper faces of the at least one die and an area of the rotatable wheel pointed to by the pointer.

The boxed areas for wagering on colors include boxed areas for wagering on a) all the same color based on combinations of colors both on the upper faces of the at least one die and an area of the rotatable wheel pointed to by the pointer; b) two different colors based on combinations of colors both on the upper faces of the at least one die and an area of the rotatable wheel pointed to by the pointer; and c) three different colors based on combinations of colors both on the upper faces of the at least one die and an area of the rotatable wheel pointed to by the pointer.

In accordance with another aspect of the present invention, a gambling game includes a dice table having an upper throwing surface on which dice can be thrown; two dice to be thrown on the upper throwing surface by a player, each die having a plurality of faces, each face having a number different from the numbers on the other faces thereon and having a color thereon, with the colors of at least some of the faces being different from the colors of other ones of the faces; a rotatable wheel to be rotated by a dealer and positioned adjacent the dice table, the rotatable wheel having at least six segmented areas, each segmented area having a number different from the numbers on the other segmented areas thereon and having a color thereon, with the colors of at least some of the segmented areas being different from the colors of other ones of the segmented areas; a pointer fixed at a periphery of the rotatable wheel and positioned to point to each segmented area as the segmented areas pass by the pointer; and a wagering area for wagering on color combinations and number combinations from a combination of colors and numbers both on the upper faces of the at least one die and a segmented area of the rotatable wheel pointed to by the pointer.

In accordance with still another aspect of the present invention, a method of playing a gambling game, includes the steps of rotating a rotatable wheel having a plurality of segmented areas with different numbers and colors thereon; providing at least one die, each die having a plurality of faces, each face having a number and a color thereon, with the numbers and colors of at least some of the faces being different from the numbers and colors of other ones of the faces; throwing the at least one die on an upper throwing surface of a dice table; and wagering on color combinations and number combinations from a combination of colors and numbers both on upper faces of the at least one die and on an area of the rotatable wheel pointed to by a pointer.

The above and other objects, features and advantages of the invention will become readily apparent from the following detailed description thereof which is to be read in connection with the accompanying drawings.

DETAILED DESCRIPTION

Figure 1:
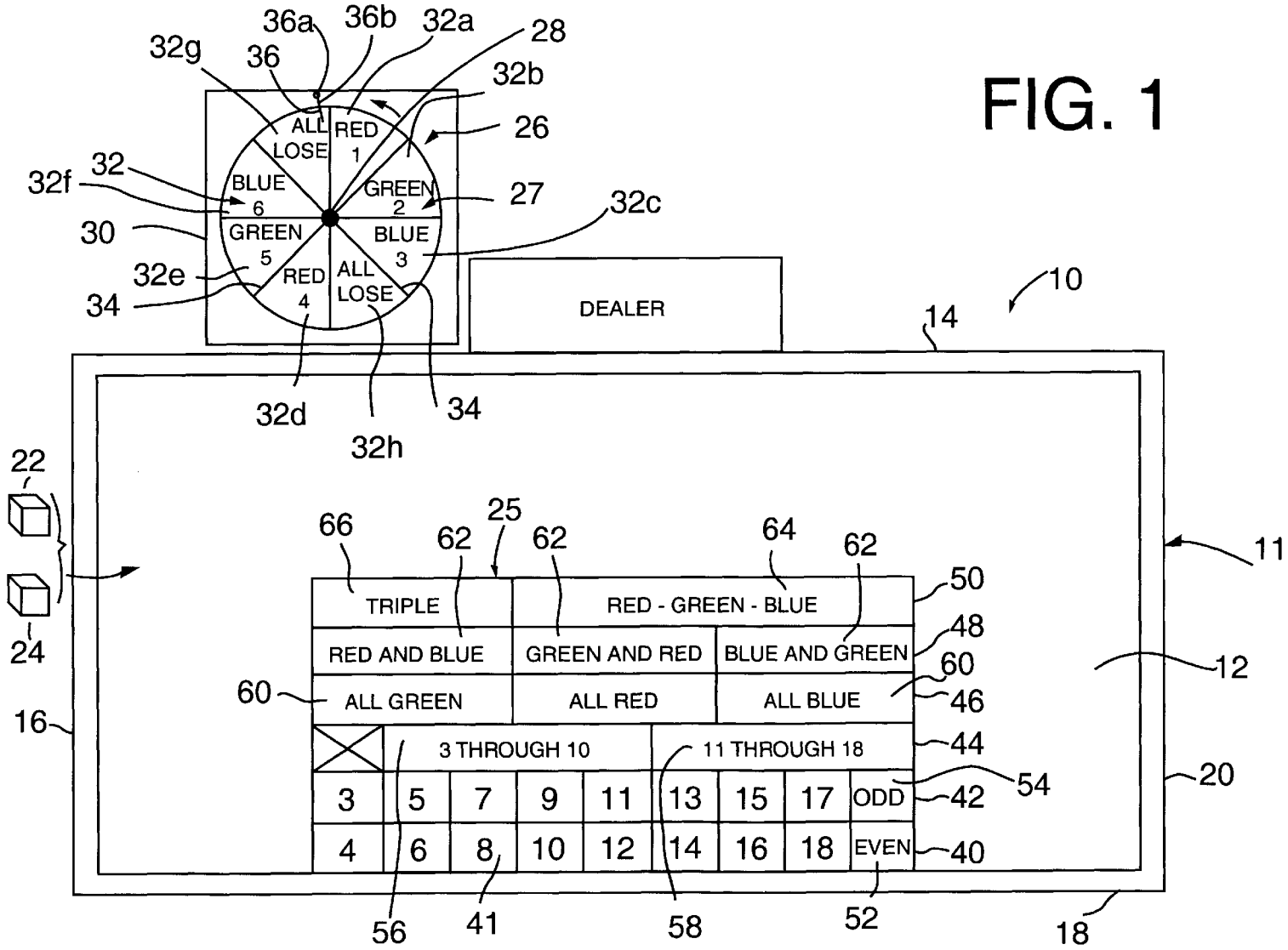
FIG. 1 is a top plan view of a gambling game according to the present invention.

Referring to the drawings in detail, and initially to FIG. 1 thereof, a gambling game 10 according to the present invention includes a dice table 11 with a rectangular upper throwing surface 12 generally covered by a felt or like fabric, and four side walls 14, 16, 18 and 20 upstanding from outer edges of upper throwing surface 12. The felt will cause dice thrown therein to roll rather than slide. Thus, a player or shooter can throw a pair of dice 22 and 24 onto upper throwing surface 12. Dice 22 and 24 are prevented from escaping from upper throwing surface by side walls 14, 16, 18 and 20, and may even bounce off of these side walls. A wagering area 25 is printed on upper throwing surface 12, and will be discussed in greater detail hereinafter. Preferably, the dealer of the casino or house stands at side wall 14 opposite wagering area 25 which is arranged adjacent the opposite side wall 18.

Figure 2:
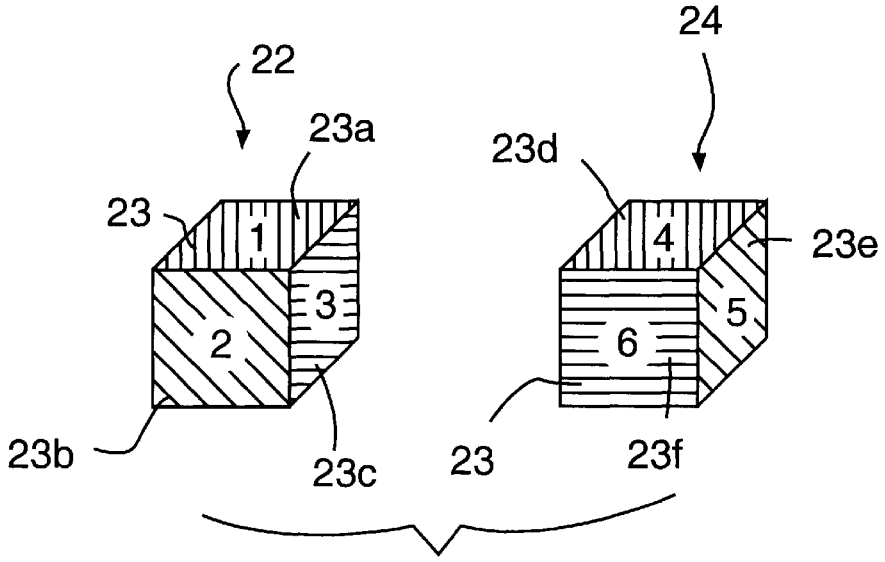
FIG. 2 is an enlarged perspective view of the dice.

Dice 22 and 24 are shown in detail in FIG. 2 and each die 22 and 24 includes six faces 23, each face having a number from "1" through "6", as well as one of three colors, for example, red, green or blue, as shown by the hatching for color in FIG. 2. Thus, for example, each die 22 and 24 can have numbers "1" and "4" on respective red faces 23*a* and 23*d*, numbers "2" and "5" on respective green faces 23*b* and 23*e*, and numbers "3" and "6" on respective blue faces 23*c* and 23*f*. Preferably, each die 22 and 24 is identical to the other, although the present invention is not so limited.

In addition, gambling game 10 includes a wheel 26 that is rotatably mounted on an axle 28 in a case 30 which is positioned adjacent to side wall 14 and thereby, which is adapted to be spun or rotated by the dealer. Wheel 26 can be rotated by grasping an edge thereof and spinning the same.

Wheel 26 has an upper surface 27 that is divided into eight segmented areas 32, although the present invention is not so limited. Segmented areas 32 are separated by raised metal dividers or separators 34. Six of the segmented areas 32 include a number "1" through "6", respectively, as well as one of the same three colors red, green or blue, although other colors can be used. Thus, segmented areas 32 include a red segmented area 32*a* with the number "1" thereon, a green segmented area 32*b* with the number "2" thereon, a blue segmented area 32*c* with the number "3" thereon, a red segmented area 32*d* with the number "4" thereon, a green segmented area 32*e* with the number "5" thereon, and a blue segmented area 32*f* with the number "6" thereon. The remaining two segmented areas 32*g* and 32*h* include a designation "ALL LOSE".

A flexible plastic pointer 36 is fixed at one end 36*a* to case 30, and the opposite pointer end 36*b* extends immediately over upper surface 27. Thus, as wheel 26 is rotated, metal dividers 34, in turn, hit against pointer end 36*b*. Each time that pointer end 36*b* is hit, pointer 36 flexes to permit the respective metal divider 34 to pass by, whereupon pointer end 36*b* springs back into the next segmented area 28. Continual hitting of pointer end 36*b* by dividers 34 functions to slow down wheel 26, and eventually cause wheel 26 to stop, whereupon pointer end 36*b* remains in a particular segment 32.

Figure 3:
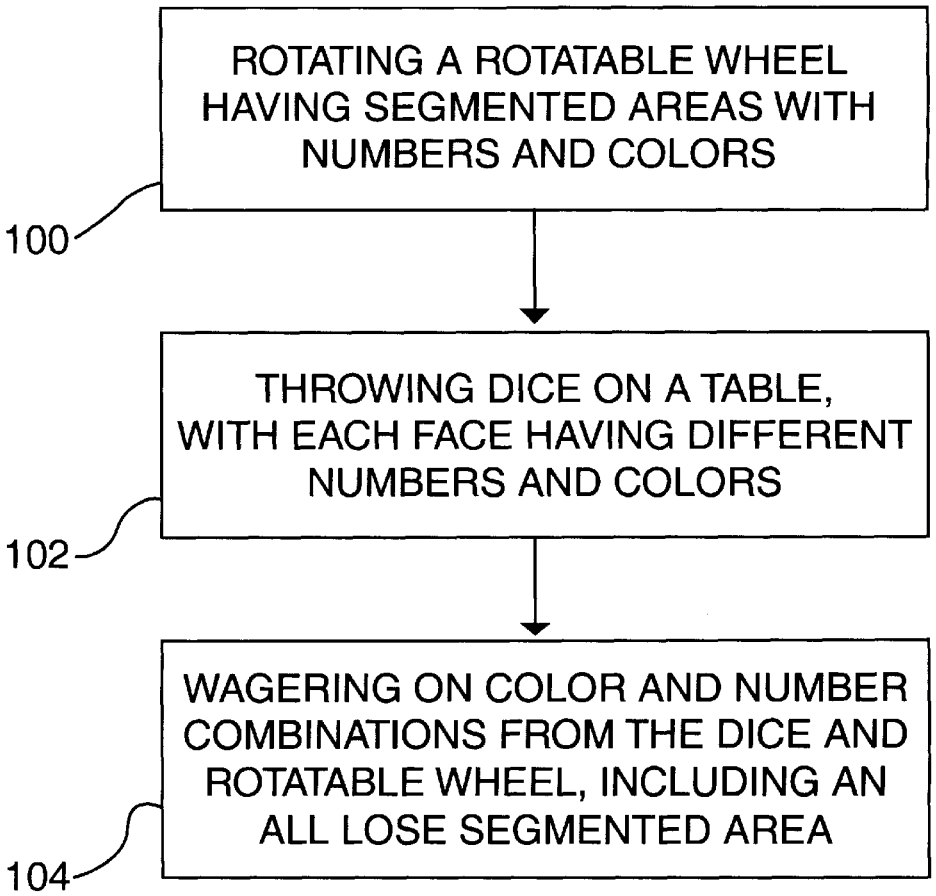
FIG. 3 is a flow chart diagram explaining the operation of the present invention.

Gambling game 10 is played by the dealer spinning wheel 26, as shown in step 100 of FIG. 3, and while wheel 26 is spinning, a shooter or player throws dice 22 and 24 onto upper surface 12 of dice table 11, as shown in step 102 of FIG. 3. Wagering is made prior to these operations, on wagering area 25, by reason of the combinations from dice 22 and 24, and wheel 26, as shown in step 104 of FIG. 3.

As shown in FIG. 1, wagering area 25 includes different columns 40, 42, 44, 46, 48 and 50, by which a player can place different bets, based on both colors and numbers, from a combination of wheel 26 rotated by the dealer and dice 22 and 24 thrown by the shooter or player.

Specifically, there are 16 possible number combinations from "3" through "18" that can be obtained from adding up the numbers on the upper faces of both dice 22 and 24 and the segmented area 32 of wheel 26 that is pointed to by pointer 36. Thus, columns 40 and 42 are divided into sixteen number boxes 41, each having a single number combination from "3" through "18" therein. Based on these combinations, a player can wager on a particular number combination expected to win in either column 40 or column 42. Thus, for example, the player can wager on the number combination "8" by placing a chip in the number box 41 having the number combination "8" therein. The player can also wager on two possible number combinations, for example, by placing a chip to straddle the number boxes 41 containing the numbers "3" and "4". A wager on four number combinations can also be made by placing a chip at the meeting corner of the number boxes 41 containing the four number combinations, for example, the number areas 41 containing the number combinations "5", "6", "7" and "8".

The player can also wager on all even numbers or all odd numbers by placing a chip in the boxes 52 or 54, respectively, of columns 40 and 42, which contain the designations "EVEN" and "ODD", respectively. For example, if a player bets the even number box 52, and the number combination is "8", the player wins, and if the number combination is "9", the player loses.

The player can also wager on groups of number combinations, such as low number combinations "3" through "10" by placing a chip in low number combination box 56, or high number combinations "11" through "18" by placing a chip in high number combination box 58, both in column 44.

Of course, it will be appreciated that the pay-off return to the player will vary depending whether a single number combination, such as "4", or whether a group of number combinations, such as "3" and "4", or "3" through "10", is wagered. This is because the probability of selecting a single number combination is much less than the probability for selecting a group of number combinations.

In addition to the number combinations, a player can also wager on colors or color combinations. For example, in column 46, the player can wager that the pointed to color on wheel 26 and the colors on both dice 22 and 24 will be the same color, such as all green, all red or all blue, in single color boxes 60. In column 48, the player can wager that two of the selected colors will turn up on wheel 26 and dice 22 and 24, by selecting red-blue, green-red or green-blue in double color boxes 62. For example, if pointer 36 stops at red segment 32*a* on wheel 26, and dice 22 and 24 show red and green colors, respectively, at their upper surfaces, a chip placed on the red-green combination in double color box 62 will win. Further, in triple color box 64 in column 50, the player can wager that all three different colors red, green and blue will turn up on wheel 26 and dice 22 and 24.

The pay-off return to the player will be the same, regardless of whether a single color combination, a double color combination or a triple color combination is selected, since the probabilities for all such color combinations is the same.

Lastly, the player can place a further chip on TRIPLE box 66, in which case any winnings are automatically tripled.

If pointer 36 stops at ALL LOSE area 32*g* or 32*h* on wheel 26, everyone loses, regardless of what else turns up on dice 22 or 24. This gives the house or casino the slight margin for winning in its favor.

Thus, gambling game 10 includes a combination of a rotatable wheel and at least two dice, in which action is required by the player and the dealer, thereby maintaining the interest and camaraderie of the players in the game. Further, by using both a wheel and dice, gambling game 10 is provided with an increased number and variation of ways to wager. Also, unlike craps, with gambling game 10, the players can easily understand the different wagers that can be made.

It will be appreciated that various modifications can be made to the present invention, within the scope of the claims. Thus, wagering area 25 can be modified to provide a greater or lesser number of types of wagers that can be made. For example, columns 40 and 42 can be further divided into four columns to increase the types of wagers. Also, although only three colors have been shown, more than three colors can be provided to increase the types of wagers. Further, although six sided dice 22 and 24 have been shown, a greater number of sides on dice 22 and 24 can be provided, to increase the numbers and/or colors thereon. Wheel 26 can also be divided into more than eight segments 32, to increase the numbers and/or colors thereon. Also, although wheel 26 has been shown in a particular configuration, a roulette wheel can be used in place thereof, with the number of pockets in the roulette wheel corresponding to the number of segments 32, and in which a ball is provided in combination therewith.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

What is claimed is:

1. A gambling game apparatus comprising:

a dice table having an upper throwing surface on which dice can be thrown;

at least one die to be thrown on said upper throwing surface by a player, each die having a plurality of faces, each face having a number and a color thereon, with the numbers and colors of at least some of the faces being different from the numbers and colors of other ones of the faces;

a rotatable wheel to be rotated by a dealer and positioned adjacent the dice table, the rotatable wheel having a plurality of areas with different numbers and colors thereon;

an indicator associated with the rotatable wheel for indicating one of said areas of said rotatable wheel;

a wagering area for wagering on:

mathematical combinations from a combination of numbers on both the upper faces of said at least one die and an area of said rotatable wheel indicated by said indicator, and color combinations from a combination of colors on both the upper faces of said at least one die and an area of said rotatable wheel indicated by said indicator.

2. A gambling game apparatus according to claim 1, wherein said at least one die includes two dice.

3. A gambling game apparatus according to claim 1, wherein each of said at least one die includes six faces, each face with a respective number "1" through "6".

4. A gambling game apparatus according to claim 1, wherein each die includes six faces, with a first two of the faces including a first color, a second two of the faces including a second color, and a third two of the faces including a third color.

5. A gambling game apparatus according to claim 1, wherein said wheel includes at least six areas thereon which are formed as segments of said wheel.

6. A gambling game apparatus according to claim 5, wherein said at least six areas of said wheel each include a respective number "1" through "6".

7. A gambling game apparatus according to claim 5, wherein said at least six areas include three colors, respectively, with a first two of the areas including a first one of the colors, a second two of the areas including a second one of the colors, and a third two of the areas including a third one of the colors.

8. A gambling game apparatus according to claim 5, wherein said at least six areas include at least one additional all lose area in which a player loses all wagers, regardless of color combinations and number combinations that result.

9. A gambling game apparatus according to claim 1, wherein said wagering area includes boxed areas for wagering on:

a) individual numbers based on combinations of numbers both on the upper faces of said at least one die and an area of said rotatable wheel indicated by said indicator;

b) groups of numbers based on combinations of numbers both on the upper faces of said at least one die and an area of said rotatable wheel indicated by said indicator; and c) colors based on combinations of colors both on the upper faces of said at least one die and an area of said rotatable wheel indicated by said indicator.

10. A gambling game apparatus according to claim 9, wherein said boxed areas for wagering on colors include boxed areas for wagering on:

a) all the same color based on combinations of colors both on the upper faces of said at least one die and an area of said rotatable wheel indicated by said indicator;

b) two different colors based on combinations of colors both on the upper faces of said at least one die and an area of said rotatable wheel indicated by said indicator; and c) three different colors based on combinations of colors both on the upper faces of said at least one die and an area of said rotatable wheel indicated by said indicator.

11. A gambling game apparatus comprising:

a dice table having an upper throwing surface on which dice can be thrown;

two dice to be thrown on said upper throwing surface by a player, each die having a plurality of faces, each face having a number different from the numbers on the other faces thereon and having a color thereon, with the colors of at least some of the faces being different from the colors of other ones of the faces;

a rotatable wheel to be rotated by a dealer and positioned adjacent the dice table, the rotatable wheel having at least six segmented areas, each segmented area having a number different from the numbers on the other segmented areas thereon and having a color thereon, with the colors of at least some of the segmented areas being different from the colors of other ones of the segmented areas;

an indicator associated with the rotatable wheel for indicating one of said segmented areas of said rotatable wheel;

a wagering area for wagering on:

mathematical combinations from a combination of numbers on both the upper faces of said dice and a segmented area of said rotatable wheel indicated by said indicator, and color combinations from a combination of colors on both the upper faces of said dice and a segmented area of said rotatable wheel indicated by said indicator.

12. A gambling game apparatus according to claim 11, wherein each said die includes six faces, each face with a respective number "1" through "6".

13. A gambling game apparatus according to claim 12, wherein each die includes three colors, with a first two of the faces including a first one of the colors, a second two of the faces including a second one of the colors, and a third two of the faces including a third one of the colors.

14. A gambling game apparatus according to claim 11, wherein said at least six segmented areas of said wheel each include a respective number "1" through "6".

15. A gambling game apparatus according to claim 14, wherein said at least six segmented areas include three colors, respectively, with a first two of the segmented areas including a first one of the colors, a second two of the segmented areas including a second one of the colors, and a third two of the segmented areas including a third one of the colors.

16. A gambling game apparatus according to claim 14, wherein said at least six segmented areas include at least one additional all lose segmented area in which a player loses all wagers, regardless of color combinations and number combinations that result.

17. A gambling game apparatus according to claim 11, wherein said wagering area includes boxed areas for wagering on:

a) individual numbers based on combinations of numbers both on the upper faces of said dice and a segmented area of said rotatable wheel indicated by said indicator;

b) groups of numbers based on combinations of numbers both on the upper faces of said dice and a segmented area of said rotatable wheel indicated by said indicator; and c) colors based on combinations of colors both on the upper faces of said dice and a segmented area of said rotatable wheel indicated by said indicator.

18. A gambling game apparatus according to claim 17, wherein said boxed areas for wagering on colors include boxed areas for wagering on:

a) all the same color based on combinations of colors both on the upper faces of said dice and a segmented area of said rotatable wheel indicated by said indicator;

b) two different colors based on combinations of colors both on the upper faces of said dice and a segmented area of said rotatable wheel indicated by said indicator; and c) three different colors based on combinations of colors both on the upper faces of said dice and a segmented area of said rotatable wheel indicated by said indicator.

19. A method of playing a gambling game, comprising the steps of:

rotating a rotatable wheel having a plurality of segmented areas with different numbers and colors thereon;

throwing at least one die on an upper throwing surface of a dice table, with each die having a plurality of faces, each face having a number and a color thereon, with the numbers and colors of at least some of the faces being different from the numbers and colors of other ones of the faces; and wagering on:

mathematical combinations from a combination of numbers on both upper faces of said at least one die and on an area of said rotatable wheel indicated by said indicator, and color combinations from a combination of colors on both the upper faces of said at least one die and on an area of said rotatable wheel indicated by said indicator.

20. A method according to claim 19, wherein said at least one die includes two dice, each said die including six faces, each face with a respective number "1" through "6", and with a first two of the faces including a first color, a second two of the faces including a second color, and a third two of the faces including a third color.

21. A method according to claim 19, wherein said wheel includes at least six segmented areas thereon which are formed as segments of said wheel, said at least six segmented areas of said wheel each including a respective number "1" through "6", respectively, and said at least six segmented areas including three colors, respectively, with a first two of the segmented areas including a first one of the colors, a second two of the segmented areas including a second one of the colors, and a third two of the segmented areas including a third one of the colors.

22. A method according to claim 21, wherein said at least six segmented areas include at least one additional all lose segmented area in which a player loses all wagers, regardless of color combinations and number combinations that result.

23. A method according to claim 19, wherein said step of wagering includes the sub-step of wagering on at least one of the following:

a) individual numbers based on combinations of numbers both on the upper faces of said at least one die and a segmented area of said rotatable wheel indicated by said indicator;

b) groups of numbers based on combinations of numbers both on the upper faces of said at least one die and a segmented area of said rotatable wheel indicated by said indicator; and c) colors based on combinations of colors both on the upper faces of said at least one die and a segmented area of said rotatable wheel indicated by said indicator.

24. A method according to claim 23, wherein said sub-step of wagering on colors includes the sub-step of wagering on:

a) all the same color based on combinations of colors both on the upper faces of said at least one die and a segmented area of said rotatable wheel indicated by said indicator;

b) two different colors based on combinations of colors both on the upper faces of said at least one die and a segmented area of said rotatable wheel indicated by said indicator; and c) three different colors based on combinations of colors both on the upper faces of said at least one die and a segmented area of said rotatable wheel indicated by said indicator.

* * * * *